US009814654B2

(12) United States Patent
Saxton

(10) Patent No.: US 9,814,654 B2
(45) Date of Patent: Nov. 14, 2017

(54) COLLAPSIBLE PACIFIER

(71) Applicant: MUNCHKIN, INC., Van Nuys, CA (US)

(72) Inventor: Matthew Joseph Saxton, Agoura, CA (US)

(73) Assignee: MUNCHKIN, INC., Van Nuys, CA (US)

( * ) Notice: Subject to any disclaimer, the term of this patent is extended or adjusted under 35 U.S.C. 154(b) by 12 days.

(21) Appl. No.: 14/201,691

(22) Filed: Mar. 7, 2014

(65) Prior Publication Data

US 2014/0257387 A1 Sep. 11, 2014

Related U.S. Application Data

(60) Provisional application No. 61/775,414, filed on Mar. 8, 2013.

(51) Int. Cl.
*A61J 17/00* (2006.01)

(52) U.S. Cl.
CPC ..... *A61J 17/008* (2015.05); *A61J 17/001* (2015.05)

(58) Field of Classification Search
CPC ..... A61J 17/00; A61J 17/001; A61J 17/008; A61J 9/005; A46B 17/04; A46B 11/0089; B21D 51/36; B60R 5/047; B60R 5/048; A61B 5/150534; A61B 5/150633; A61B 5/150641; A61M 2005/3267; A61M 5/1626; B65D 47/061; B65D 1/0292
USPC ..... 606/234–236; 604/192, 198, 263; 222/490; 215/11.1; 15/247
See application file for complete search history.

(56) References Cited

U.S. PATENT DOCUMENTS

| | | | | | |
|---|---|---|---|---|---|
| 1,716,262 | A * | 6/1929 | Dishart | A61J 11/008 | 215/11.6 |
| 3,363,630 | A * | 1/1968 | Hines | A61J 17/00 | 606/234 |
| 4,819,641 | A * | 4/1989 | Russell | A61J 17/00 | 215/11.3 |
| 4,946,054 | A * | 8/1990 | Maniero | A61J 11/008 | 215/11.6 |
| 5,360,423 | A * | 11/1994 | McCormick | A61J 1/2096 | 604/192 |
| 2010/0016895 | A1* | 1/2010 | Eisenberg | A61J 17/00 | 606/234 |
| 2010/0249748 | A1* | 9/2010 | Szucs | A61M 5/326 | 604/506 |
| 2012/0227860 | A1* | 9/2012 | Jeremiah | B65D 1/0292 | 141/1 |

* cited by examiner

*Primary Examiner* — Jonathan Miles
*Assistant Examiner* — Majid Jamialahmadi
(74) *Attorney, Agent, or Firm* — Robert Z. Evora, Esq.; Christian Lek

(57) ABSTRACT

A compressible pacifier having a nipple, a conical protective sleeve and a handle. The protective sleeve has a first end connected to the nipple and a second end which covers the nursing end of the nipple when in an extended position. The handle is connected to the first end of the protective sleeve. While the protective sleeve is in a retracted position, a second end of the sleeve is concentrically disposed over the first end of the sleeve thereby exposing the nursing end of the nipple for use by an infant.

20 Claims, 7 Drawing Sheets

COLLAPSIBLE PACIFIER

CROSS REFERENCE TO RELATED APPLICATION

This application claims priority to U.S. Provisional Application Ser. No. 61/775,414 filed Mar. 8, 2013; the contents of all of which are hereby incorporated by reference herein in their entirety into this disclosure.

TECHNICAL FIELD

The subject disclosure relates to a protective pacifier nipple structure, and in particular to a nipple having a collapsible outer shield surrounding the nipple being adapted to protect the nipple from unsanitary bacteria.

BACKGROUND

Conventionally, pacifiers are prone to collecting dirt and other unsanitary bacteria. Young infants and/or parents have the tendency to inadvertently drop the infant's pacifier on the floor or other unsanitary surface. In a conventional nipple-type pacifier, the nursing end of the nipple is directly exposed externally and will make direct contact with the unclean surface. Unfortunately, a frail still unvaccinated infant may be subjected to various contagious pathogens and the resultant diseases thereof.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Particular embodiments of the present invention will now be described in greater detail with reference to the figures.

Figure 2:
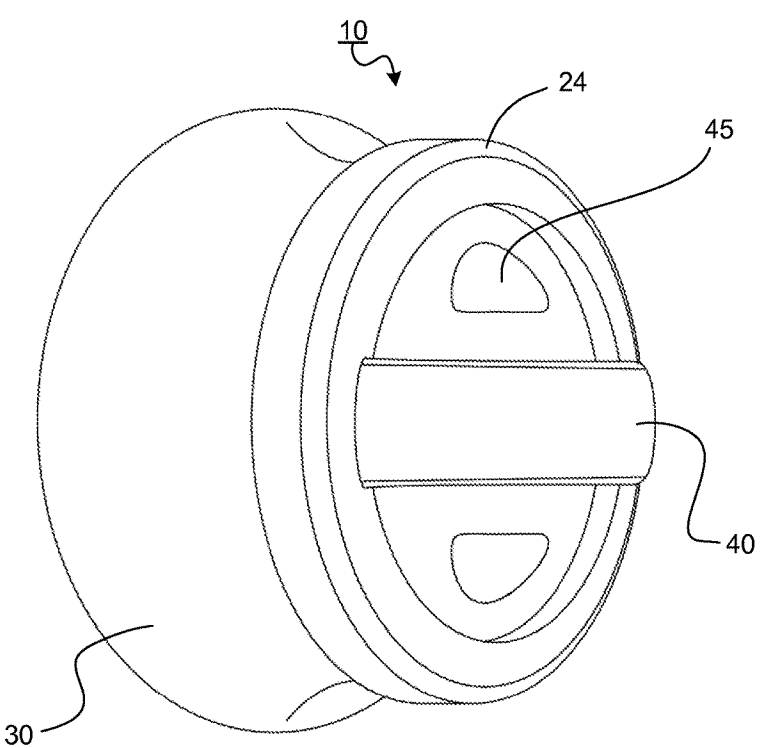
FIG. 2 shows a rear perspective view of the compressible pacifier.
Figure 1:
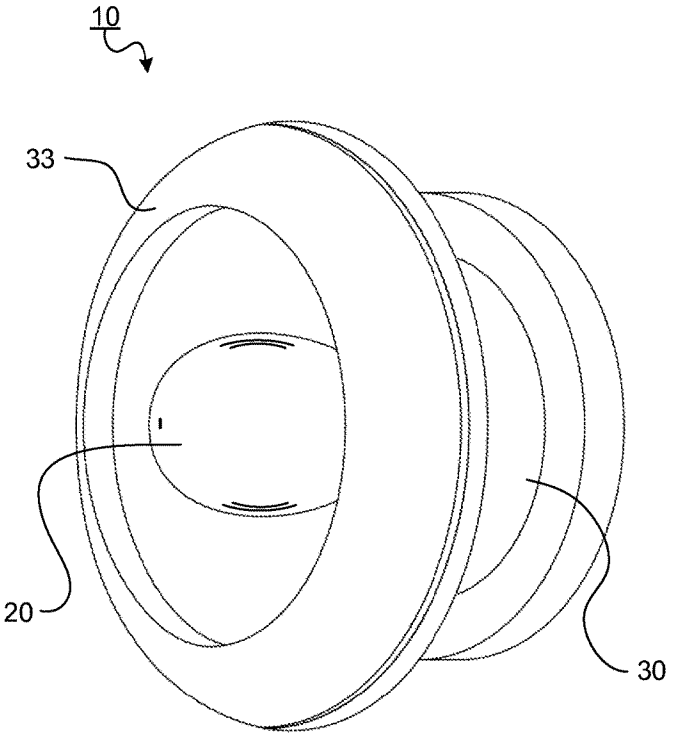
FIG. 1 illustrates a front perspective view of an exemplary compressible pacifier according to the subject disclosure.
Figure 3:
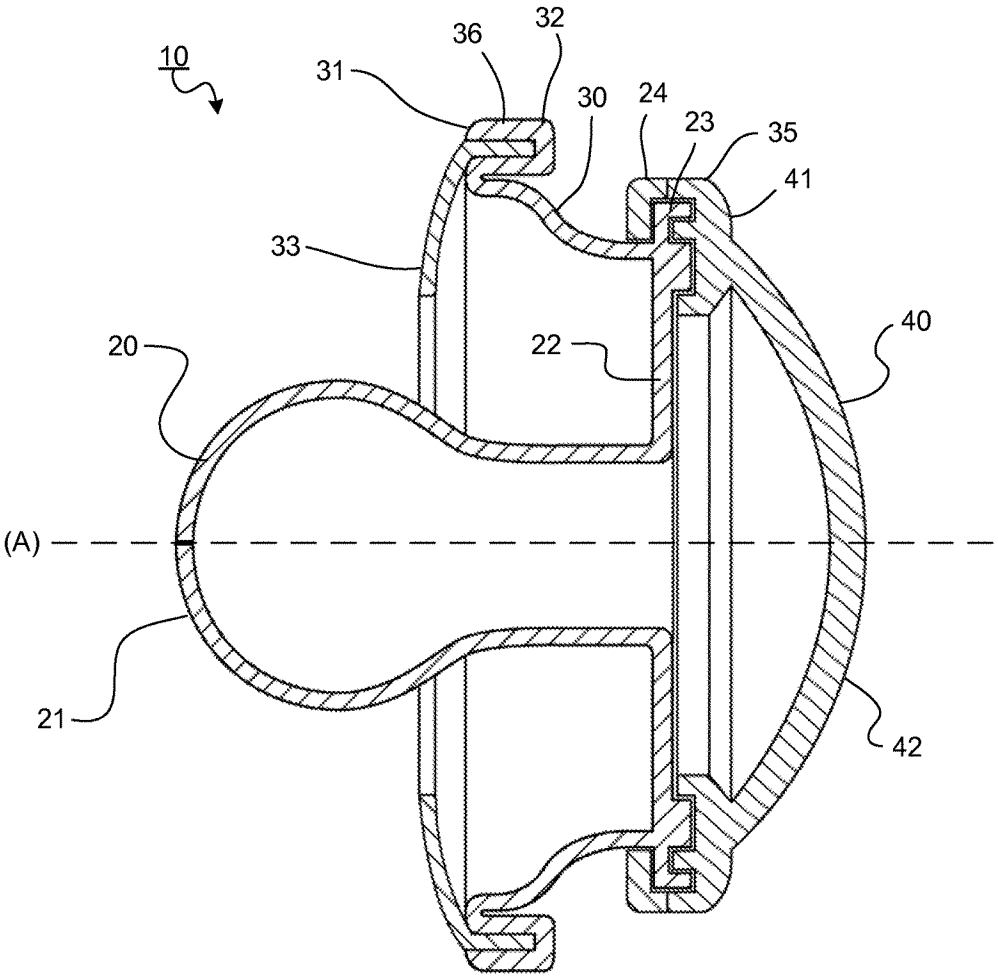
FIG. 3 depicts a cross section view of the compressible pacifier partially compressed.

FIGS. 1-2 and semi-compressed cross section FIG. 3 illustrate an exemplary collapsible pacifier 10. The structure of the collapsible pacifier 10 includes a nipple 20, a protective sleeve 30 and a handle 40.

The nipple 20 includes a first nursing end 21 that extends along an axis (A) from a lower end that terminates into a flattened disc portion 22. The flattened disc portion 22 extends radially outward from the axis (A) to a first radial edge 23.

A first ring 24 may be provided adjacent to the first radial edge 23. The first radial edge 23 is contoured to be secured between the first ring 24 and an outer ring portion 41 of the handle 40. The first radial edge 23 may also be secured to the handle 40 by any other suitable method.

The protective sleeve 30 extends from the first radial edge 23 adjacent to a second radial end 31. The shape of the protective sleeve 30 is frusto-conical. The protective sleeve 30 expands diametrically larger in an outward radial manner along the axis (A) disposed through the nipple 20. The protective sleeve 30 expands from a first smaller diameter adjacent to first radial edge 23 to a second larger diameter disposed adjacent to the second radial edge 31. The second larger diameter has an opening large enough for the nipple 20 to be pushed through.

The protective sleeve 30 may be of any suitable resilient material, preferably a soft resilient rubber, such as silicone, and/or any other suitable soft material.

A length of the protective sleeve 30 is sufficiently long enough to extend from the base of the nipple 20 at the flattened disc portion 22 to beyond the tip of the nursing end 21 of the nipple 20. The length of the protective sleeve 30 covers the nipple 20 and prevents the nipple 20 from coming into contact with contaminants such as dirt and other bacteria and transferring into the infant's mouth when coming into contact with the ground, floor and/or other unsanitary surface.

A second ring 33 is provided at the second radial end 31. The second radial end 31 is composed of a notch 32 adapted to be attached to the second ring 33 in any suitable manner. The inner diameter of the second ring 33 is smaller than an outer diameter of the first ring 24.

The handle 40 includes a grip 42 and the outer base ring 41. The outer base ring 41 is concentric and is attached to the first radial edge 23 of the protective sleeve 30. That is, the first radial edge 23 is secured between the first ring 24 and the outer base ring 41 of the handle 40. The grip 42 is attached to and extends across the diameter of the outer base ring 41.

In use, the protective sleeve 30 is compressed backward to expose the nipple 20 for use. That is, a second, larger diameter 36 end of the protective sleeve 30 is pulled back adjacent to a first, smaller diameter 35 end of the protective sleeve 30.

Figure 4:
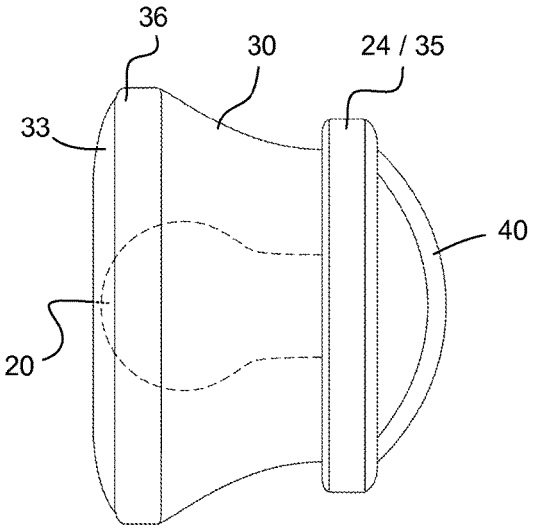
FIGS. 4-7 illustrate various views showing the incremental steps for compressing the protective sleeve of the compressible pacifier.

FIGS. 4-7 illustrate, in more detail, the use of the collapsible pacifier 10. In FIG. 4, the protective sleeve 30 is shown fully extended over the nipple 20. The second, larger diameter 36 end of the conical protective sleeve 30 is depicted fully extended away from the first, smaller diameter 35 end of the protective sleeve 30. In this storage position, the nipple 20 is completely covered and protected from uncleanly external surfaces coming into contact with it.

Figure 5:
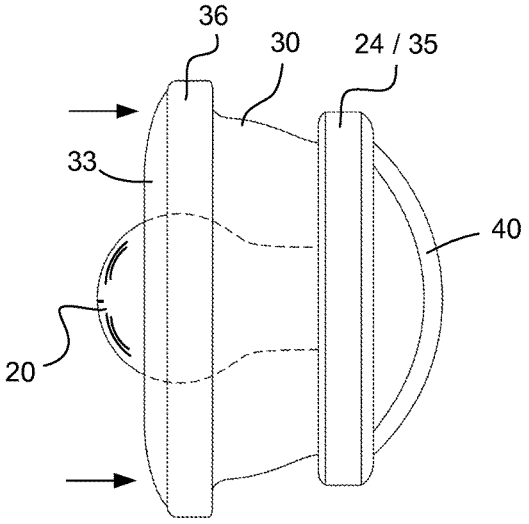
Figure 6:
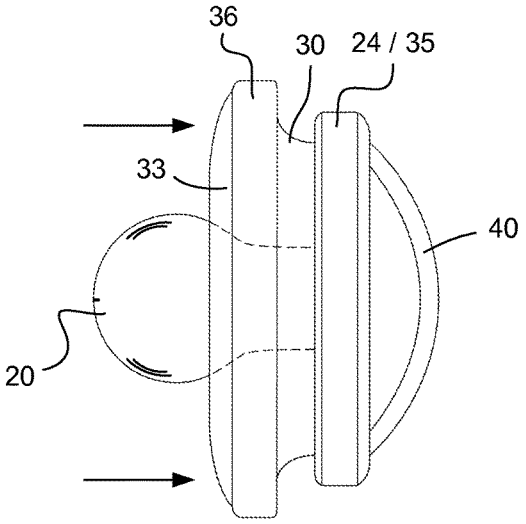

In FIGS. 5-6, the protective sleeve 30 is shown partially compressed incrementally, thereby beginning to expose the nipple 20 through the open end 38 of the protective sleeve 30. The second, larger diameter 36 end of the conical protective sleeve 30 is partially retracted back toward the first, smaller diameter 35. The protective sheet 30 is folded out of the way.

Figure 7:
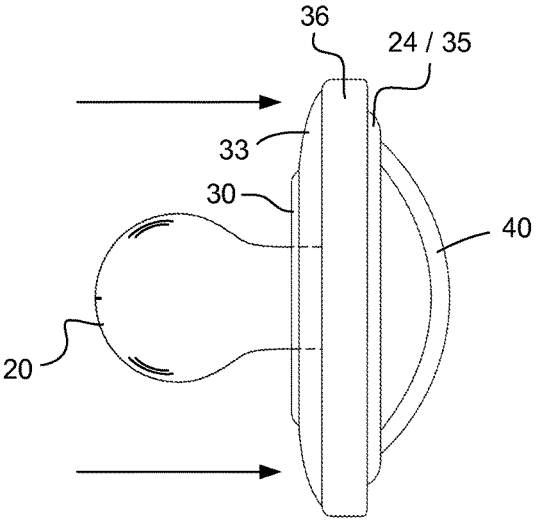

In FIG. 7, the protective sleeve 30 is shown compressed, completely exposing the nipple 20. The second, larger diameter 36 end of the conical protective sleeve 30 is fully retracted back and the nipple projects outside the protective sleeve 30 ready for suckling by the infant. In this position, the second, larger diameter 36 end of the conical protective sleeve 30 is provided concentrically over the first, smaller diameter 35 of the protective sleeve 30 as shown in FIG. 8.

The dimensions of the second ring 33 in the second, larger diameter 36 and the first ring 24 in the first, smaller diameter 35 may be dimensioned so that there is a friction slip-fit provided to prevent the second, larger diameter 36 from slipping off of the first, smaller diameter 35 while in use.

In addition, the second ring 33 may be slightly biased away from the first ring 24. The force of the bias will be less than the friction slip-fit preventing the second, larger diameter 36 from slipping off of the first, smaller diameter 35 while in use. However, adding a slight bias will allow the protective sleeve to fully extend in the case that the compressible pacifier 10 falls and hits a floor or table, thus covering the nipple 20.

Figure 8:
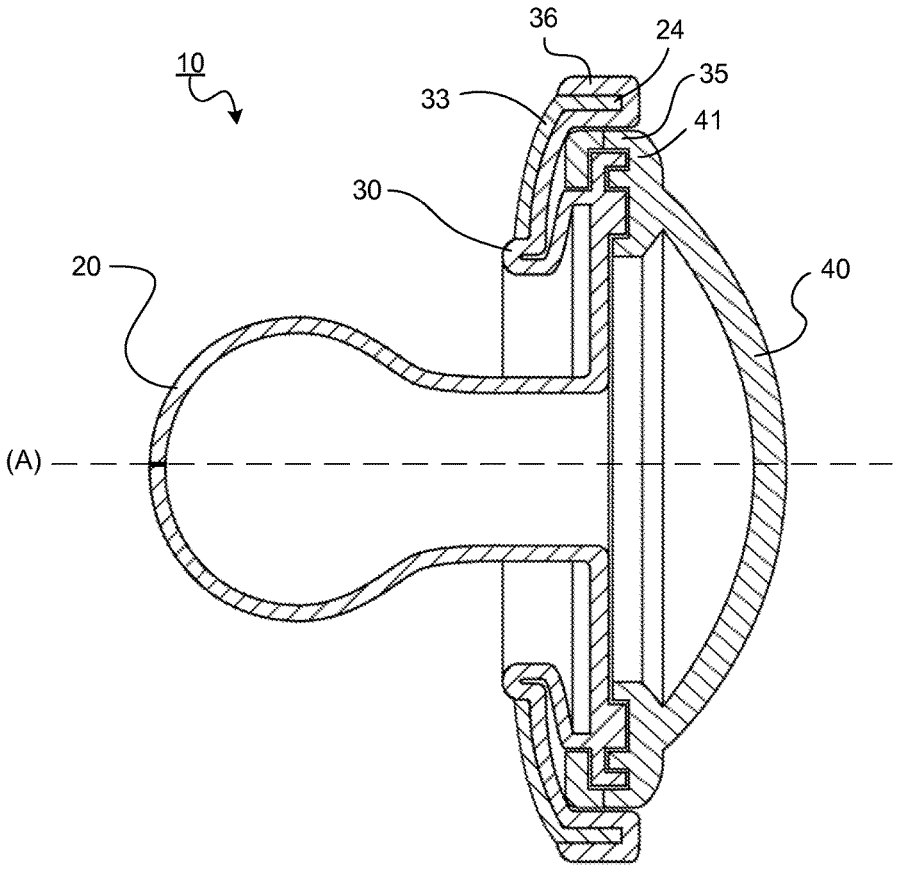
FIG. 8 shows a cross section view of the compressible pacifier in a compressed position.
Figure 10:
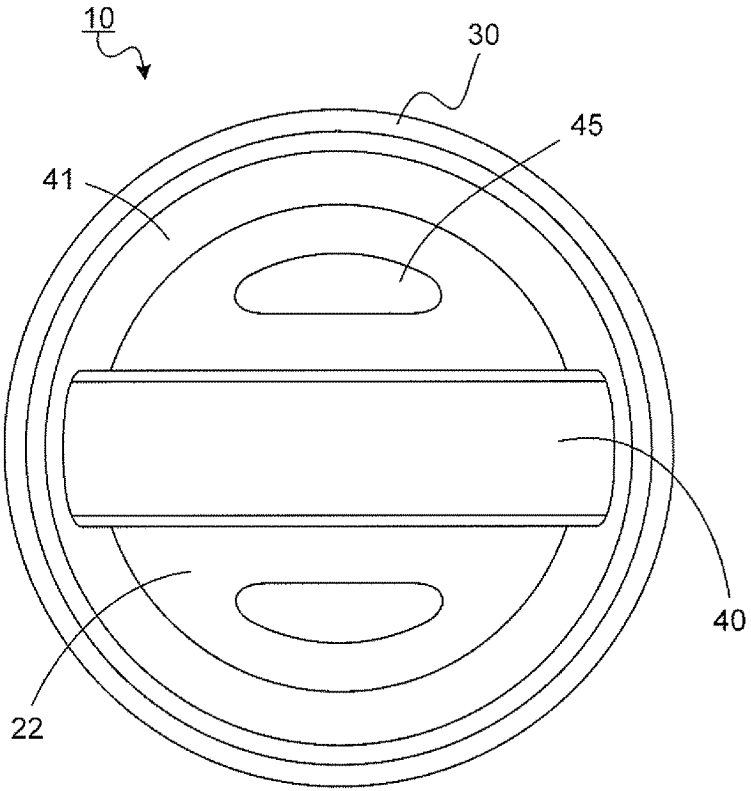
FIG. 10 illustrates a rear view of the compressible pacifier.
Figure 9:
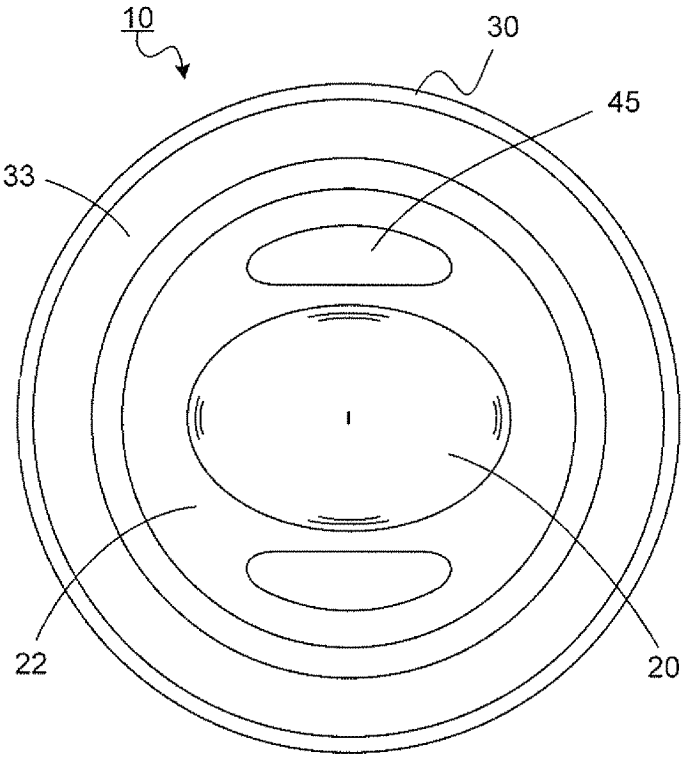
FIG. 9 depicts a front view of the compressible pacifier.
Figure 12:
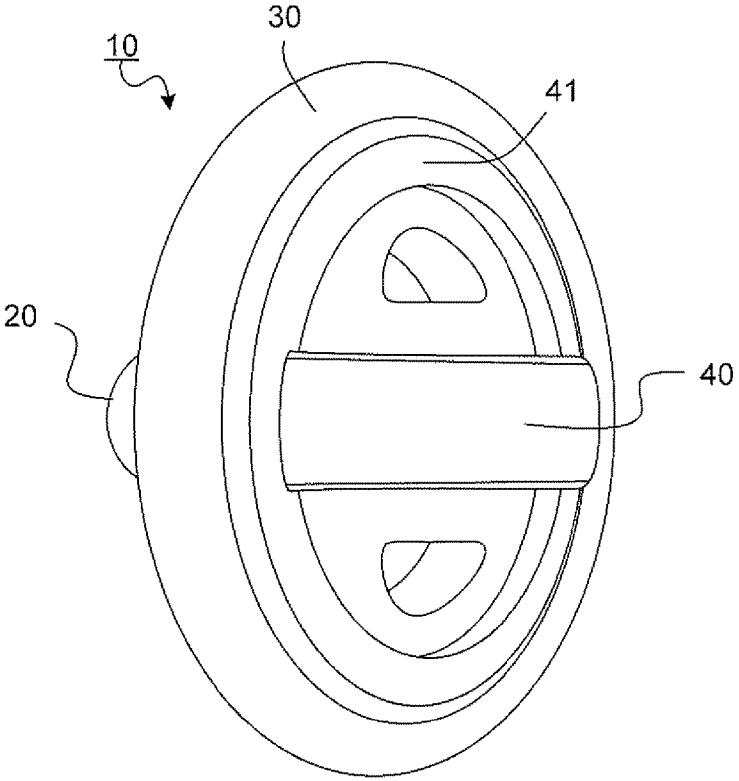
FIG. 12 depicts a rear perspective view of the compressible pacifier in a compressed position.
Figure 11:
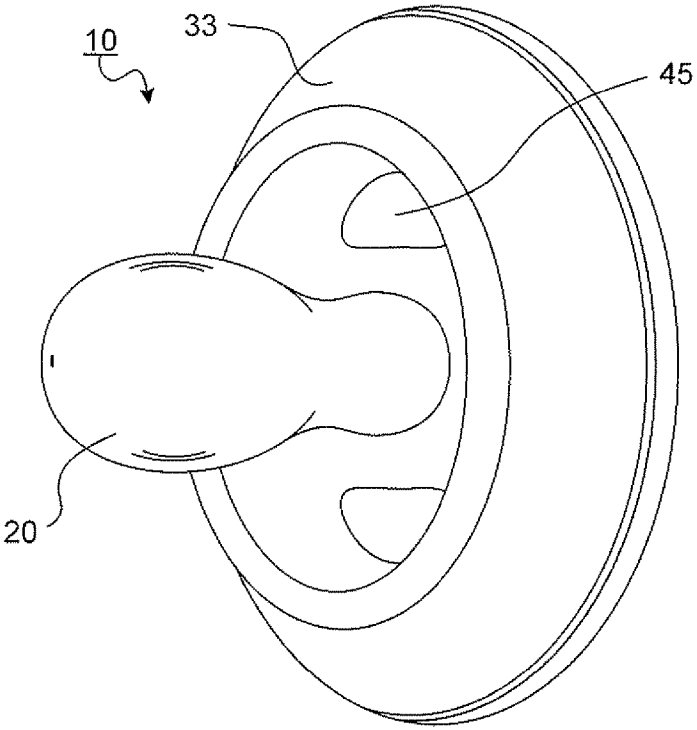
FIG. 11 shows a front perspective view of the compressible pacifier in a compressed position.

As shown in FIG. 8, the protective sleeve 30 is collapsed or folded back neatly away from the connection made between the second, larger diameter 36 and the first, smaller diameter 35. As such, the second ring 33 at the second, larger diameter 36 can be located over the first ring 24 in the first, smaller diameter 35.

In this position, the nipple 20 is fully extended and can be placed in the infant's mouth. When the infant is finished, the protective sleeve 30 can be retracted back over the nipple 20 in the reverse order shown and described in FIGS. 4-7 in order to cover the nipple 20 and keep it free of contact with unsanitary surfaces. In the original position shown in FIG. 4, once again the nursing end 21 of the nipple 20 is covered providing a hygienic and safe protective environment.

FIGS. 9-12 show front and rear views of the compressible pacifier according to this subject disclosure. Apertures 45 may be added to the flattened disc portion 22. Apertures 45 will allow water to drain from the area encompassed by the protective sheet 30 during washing and also provide additional airflow to the compressible pacifier 10 during use. The apertures 45 may also act as finger recesses to further facilitating gripping by the infant or caregiver.

Figure 13:
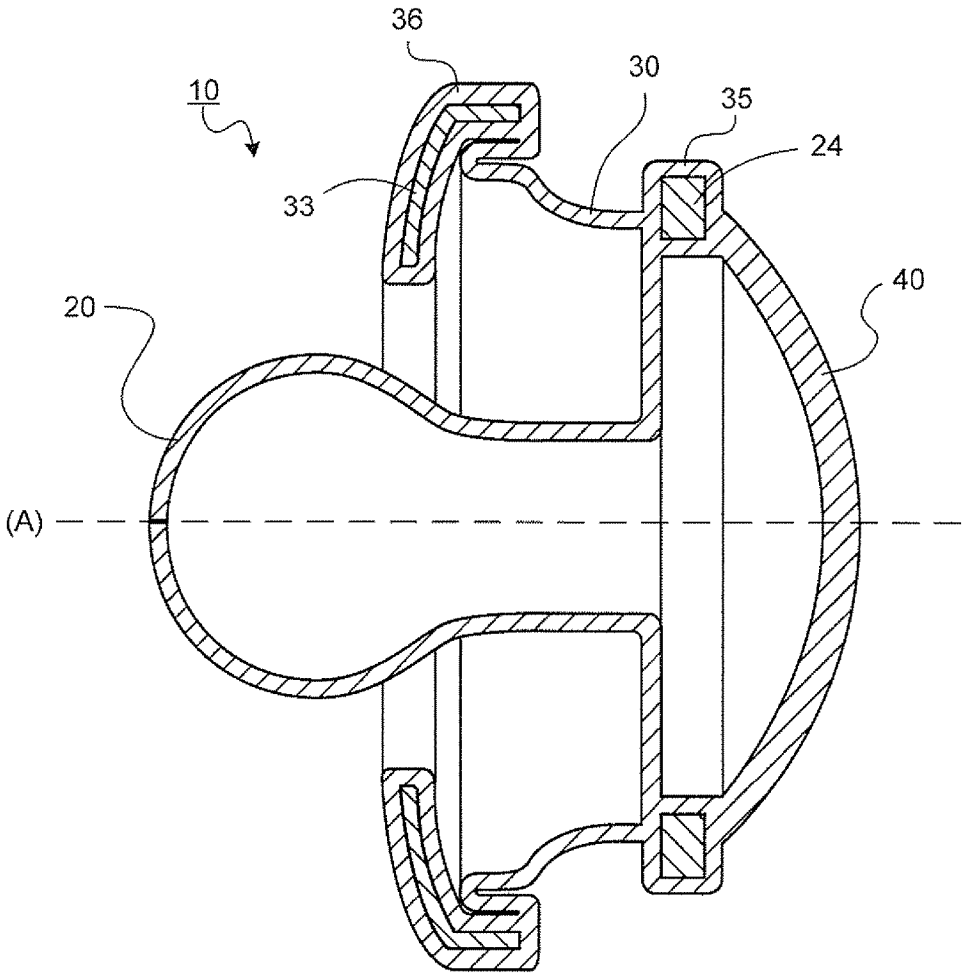
FIG. 13 illustrates a cross section of another embodiment for a compressible pacifier according to this subject disclosure.

FIG. 13 discloses another exemplary embodiment of the compressible pacifier 10 in which the first ring 24 and the second ring 33 are over-molded by a material. The material can be any pliable material capable of allowing the protective sheet 30 to compress and extend to permit access to the nipple 20 according to the subject disclosure. This exemplary embodiment functions similar to and includes all of the features and functionality described above.

In addition to the advantages described above, it is also possible to easily clean the compressible pacifier 10.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

The invention claimed is:

1. A compressible pacifier, comprising:

a nipple having a nursing end;

a conical protective sleeve having a first end connected to the nipple and a second end, in an extended position covering the nursing end of the nipple; and a handle connected to the first end of the conical protective sleeve, where, in a retracted position, the second end of the protective sleeve is concentrically disposed over and circumferentially connected to the first end of the conical protective sleeve via a friction fit between parallel walls at the circumferential connection to allow the protective sleeve to remain in the retracted position, thereby exposing the nursing end of the nipple for use by an infant.

2. The compressible pacifier as recited in claim 1, wherein the second end of the conical protective sleeve is biased away from the first end of the protective sleeve.

3. The compressible pacifier as recited in claim 1, further comprising a first ring adjacent to the first end and a second ring adjacent to the second end of the conical protective sleeve.

4. The compressible pacifier as recited in claim 3, where in the retracted position, the second ring is secured over the first ring by the friction fit.

5. The compressible pacifier as recited in claim 3, wherein the first ring and the nipple are composed of a single continuous material.

6. The compressible pacifier as recited in claim 3, wherein the first ring and second ring are over-molded by a material composing the conical protective sleeve.

7. The compressible pacifier as recited in claim 1, wherein the conical protective sleeve has a first diameter at the first end and a second diameter at the second end, and wherein the first diameter is less than the second diameter.

8. The compressible pacifier as recited in claim 1, further comprising a disc portion at the first end of the conical protective sleeve.

9. The compressible pacifier as recited in claim 8, wherein the disc portion comprises at least one aperture.

10. The compressible pacifier as recited in claim 1, wherein the nipple and the conical protective sleeve are composed of a single continuous material.

11. The compressible pacifier as recited in claim 1, where in the extended position, the second end of the conical protective sleeve extends past the nipple along a central axis running from a lower end of the nipple to the nursing end.

12. A compressible pacifier, comprising:

a nipple having a nursing end;

a flexible sleeve having a first support at a first end connected to the nipple and a second support at a second end; and a handle connected to the first support, where, in an extended position, the flexible sleeve covers the nursing end of the nipple, and in a retracted position, the second support is concentrically disposed over and circumferentially connected to the first support via a friction fit between parallel walls at the circumferential connection, thereby exposing the nursing end of the nipple.

13. The compressible pacifier as recited in claim 12, wherein the second support is biased away from the first support.

14. The compressible pacifier as recited in claim 12, where in the retracted position, the second support is secured over the first support by the friction fit.

15. The compressible pacifier as recited in claim 12, where in the extended position, the second support extends past the nipple along a central axis running from a lower end of the nipple to the nursing end.

16. The compressible pacifier as recited in claim 12, wherein the flexible sleeve is frusto-conical shaped.

17. A method for enclosing a nursing end of a nipple of a pacifier having a protective sleeve, the protective sleeve having a first end connected to the nipple and a second end, comprising the steps:

compressing the protective sleeve;

circumferentially securing the second end over the first end via a friction fit between parallel walls at a circumferential connection, thereby exposing the nursing end of the nipple without the protective sleeve springing back to an extended position; and extending the protective sleeve over the nipple and thereby covering the nursing end of the nipple.

18. The method as recited in claim 17, wherein the second end includes a second support ring that concentrically slip fits over a first support ring at the first end via the friction fit.

19. The method as recited in claim 18, wherein extending the protective sleeve includes disengaging the second support ring from the first support ring.

20. The method as recited in claim 17, wherein when the protective sleeve is extended over the nipple, the second end extends past the nipple along a central axis running from a lower end of the nipple to the nursing end.

* * * * *